US007837511B2

(12) United States Patent
Hsu

(10) Patent No.: US 7,837,511 B2
(45) Date of Patent: Nov. 23, 2010

(54) ELECTRICAL CONNECTOR HAVING IMPROVED CONNECTING MODULE

(75) Inventor: Chih-Ching Hsu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 128 days.

(21) Appl. No.: 12/321,710

(22) Filed: Jan. 22, 2009

(65) Prior Publication Data

US 2009/0186531 A1 Jul. 23, 2009

(30) Foreign Application Priority Data

Jan. 22, 2008 (CN) ..... 2008 2 0031422 U

(51) Int. Cl.
*H01R 24/04* (2006.01)

(52) U.S. Cl. ..... 439/669; 439/490; 439/676

(58) Field of Classification Search ..... 439/669, 439/490, 676, 607.01, 620.01, 76.1, 541.5
See application file for complete search history.

(56) References Cited

U.S. PATENT DOCUMENTS 6,881,096 B2 * 4/2005 Brown et al. ..... 439/620.01
6,976,877 B2 * 12/2005 Lien ..... 439/620.01
7,044,750 B1 * 5/2006 Lin ..... 439/76.1
7,153,158 B1 * 12/2006 Lee ..... 439/541.5

FOREIGN PATENT DOCUMENTS

WO WO-2005076413 8/2005

* cited by examiner

*Primary Examiner*—Edwin A. Leon
(74) *Attorney, Agent, or Firm*—Ming Chieh Chang; Wei Te Chung; Andrew C. Cheng

(57) ABSTRACT

An electrical connector (100) includes an insulative element (1) and an electrical unit (2) mounted to the insluative element. The electrical unit includes a housing (21), a terminal module (23) assembled to the housing, at least a daughter board (25) mounted to a side portion of the housing, and a connecting module (27). The connecting module has a base (271), a number of first pins (273) assembled to the base and extending through the daughter board, and at least a contacting subassembly (272) mounted to the base and having a number of second pins (277) connected to the daughter board.

18 Claims, 6 Drawing Sheets

ELECTRICAL CONNECTOR HAVING IMPROVED CONNECTING MODULE

BACKGROUND OF THE INVENTION

1. Field of the Invention

The present invention relates to an electrical connector and particularly to an electrical connector comprising an improved connecting module connected to a mother board for transmitting electrical signals.

2. Description of the Prior Art

Publication No. WO2005076413 published on Aug. 18, 2005 discloses an electrical connector. The electrical connector mounted to a printed circuit board comprises an insluative housing, a daughter board attached to a side of the housing, a plurality of LEDs (Light Emitting Diodes), a terminal module having a plurality of terminals extending through the printed circuit board, and a connecting module mounted to a bottom surface of the housing and having a base. The connecting module has a set of first contacts and a set of second contacts assembled to a side of base in a line and extending through a group of channels defined on the daughter board for forming a first electrical trace and a second electrical trace.

During assembly, it is difficult to mount the first and second contacts which are retained to a base of a connecting module in a line to expose from the corresponding channels of the printed circuit board. The assembly of the two components places maximum demands on accuracy. However even in the case of a high production quality and assembly accuracy, a rubbing of the first and second contacts in the channels is not completely excluded and this can consequently lead to a premature wearing including associated maintenance and/or repair costs.

Hence, an electrical connector is needed to solve the above problem.

BRIEF SUMMARY OF THE INVENTION

One object of the present invention is to provide an electrical connector having an improved connecting module for easily connecting with a daughter board.

The present invention provides an electrical connector mounted to a mother board comprises an insulative element and an electrical unit mounted to the insluative element. The electrical unit comprises a housing having a front wall, an intermediate wall, a top wall and a bottom wall, a terminal module assembled to the front wall of the housing and having a plurality of terminals mounted thereto, at least a daughter board attached to a side portion of the housing, and a connecting module mounted to the bottom wall of the housing and connected to the mother board. The connecting module has a base, a plurality of first pins assembled to the base and extending through the daughter board, and at least a contacting subassembly. The contacting subassembly comprises an inserting member inserting into a side portion of the base of the connecting module, and a plurality of second pins exposed from the inserting member and connecting to the daughter board.

During assembly, the first pins of the connecting module are easy to be mounted to the printed circuit board and the second pins of the connecting module are facility connected to the printed circuit board by the engagement of the contacting subassembly and the base. Therefore, it is easy to insert the first pins and the second pins to the daughter board and effective to avoid a damage of the first and second pins of the connecting module.

Other objects, advantages and novel features of the invention will become more apparent from the following detailed description of the present embodiments when taken in conjunction with the accompanying drawings.

DETAILED DESCRIPTION OF THE INVENTION

Figure 1:
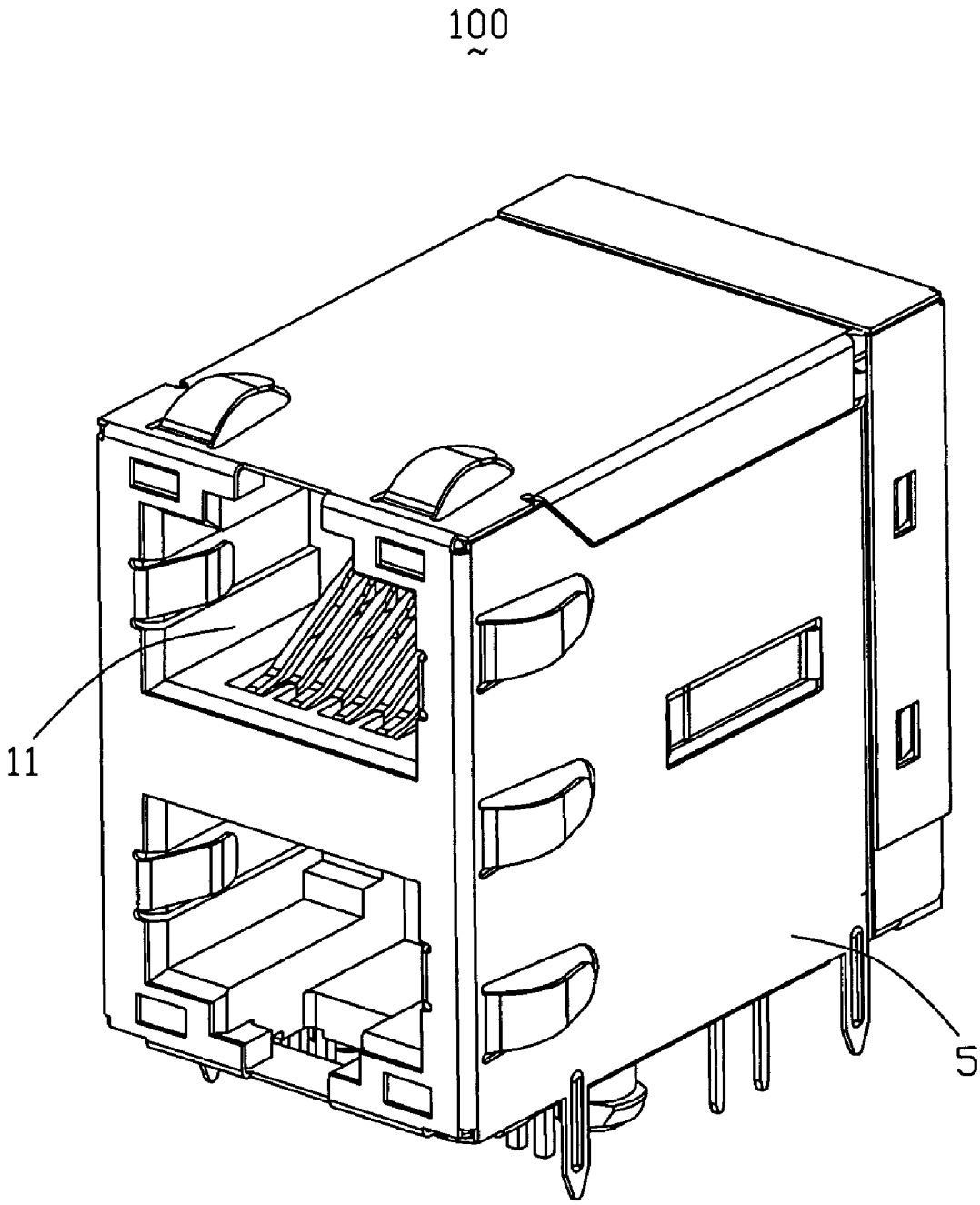
FIG. 1 is an assembled view of an electrical connector according to the present invention.
Figure 2:
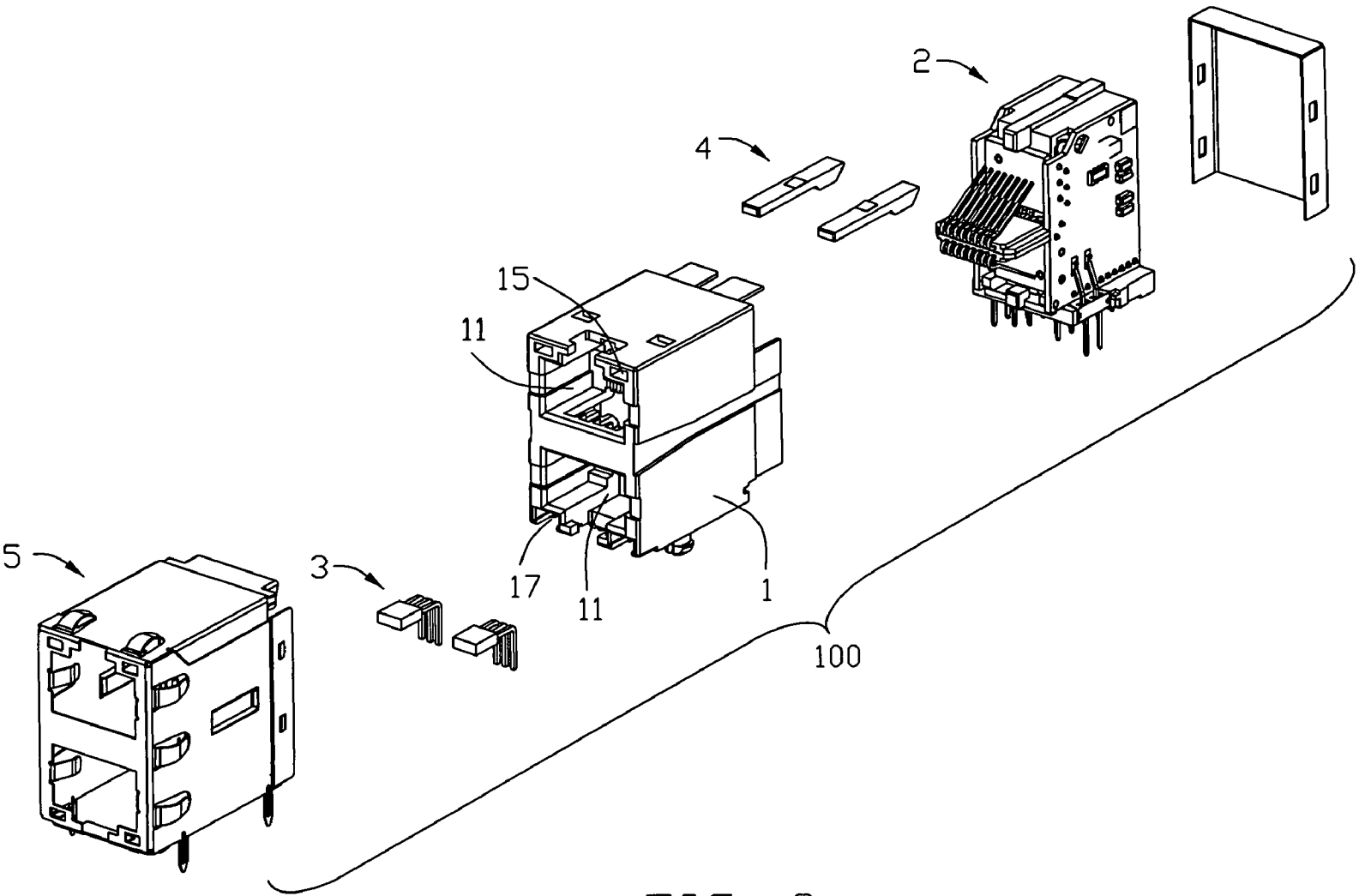
FIG. 2 is an exploded view of the electrical connector as shown in FIG. 1, taken from a forward aspect.
Figure 3:
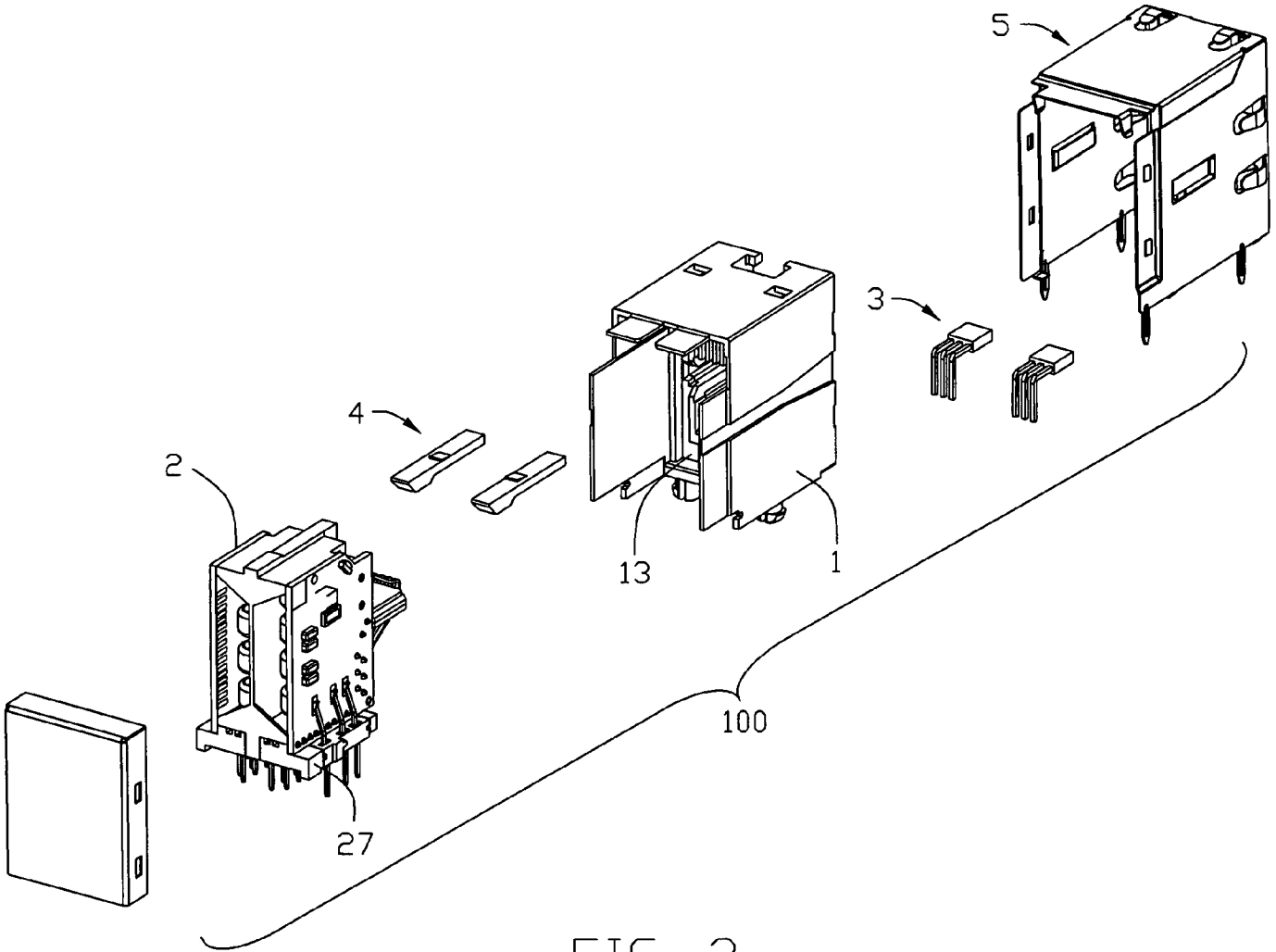
FIG. 3 is an exploded view of the electrical connector, taken from a rearward aspect.

Reference will now be made to the drawing figures to describe the present invention in detail. Referring to FIGS. 1-3, an electrical connector 100 mounted to a mother board (not shown) comprises an insulative element 1 defining a plurality of ports 11, an electrical unit 2 assembled to the ports 11 and an outer shield 5 surrounding the insulative element 1.

The electrical unit 2 comprises a housing 21, a terminal module 23 assembled to the housing 21, a pair of daughter boards 25, a connecting module 27 and a plurality of LEDs 255 soldered to the daughter board 25. The housing 21 has a front wall 211, an intermediate wall 213, a top wall 215, a bottom wall 217 and a pair of opposite spaces 219 defined between the intermediate wall 213, the front wall 211 and the bottom wall 217 for receiving a plurality of electrical components 254 which are disposed on the daughter board 25. The electrical connector 100 further comprises a plurality of lighting pipes 4 retained into the front wall 211 of the housing 21 and cooperating with the LEDs 255 for indicating a condition of an electrical signal of the electrical connector 100.

The terminal module 23 is assembled to the front wall 211 of the housing 21 and received into the ports 11 and has a plurality of terminals 231 mounted thereto for electrically engaging with a mating plug (not shown). The daughter boards 25 are mounted to a side portion of the intermediate wall 213 of the housing 21.

The daughter board 25 has a plurality first holes 253 for exposing one end 2310 of each terminals 231 of the terminal module 23, and a plurality of second holes 251 defined on a lower edge thereof and a plurality of pads 252 disposed thereon.

Figure 4:
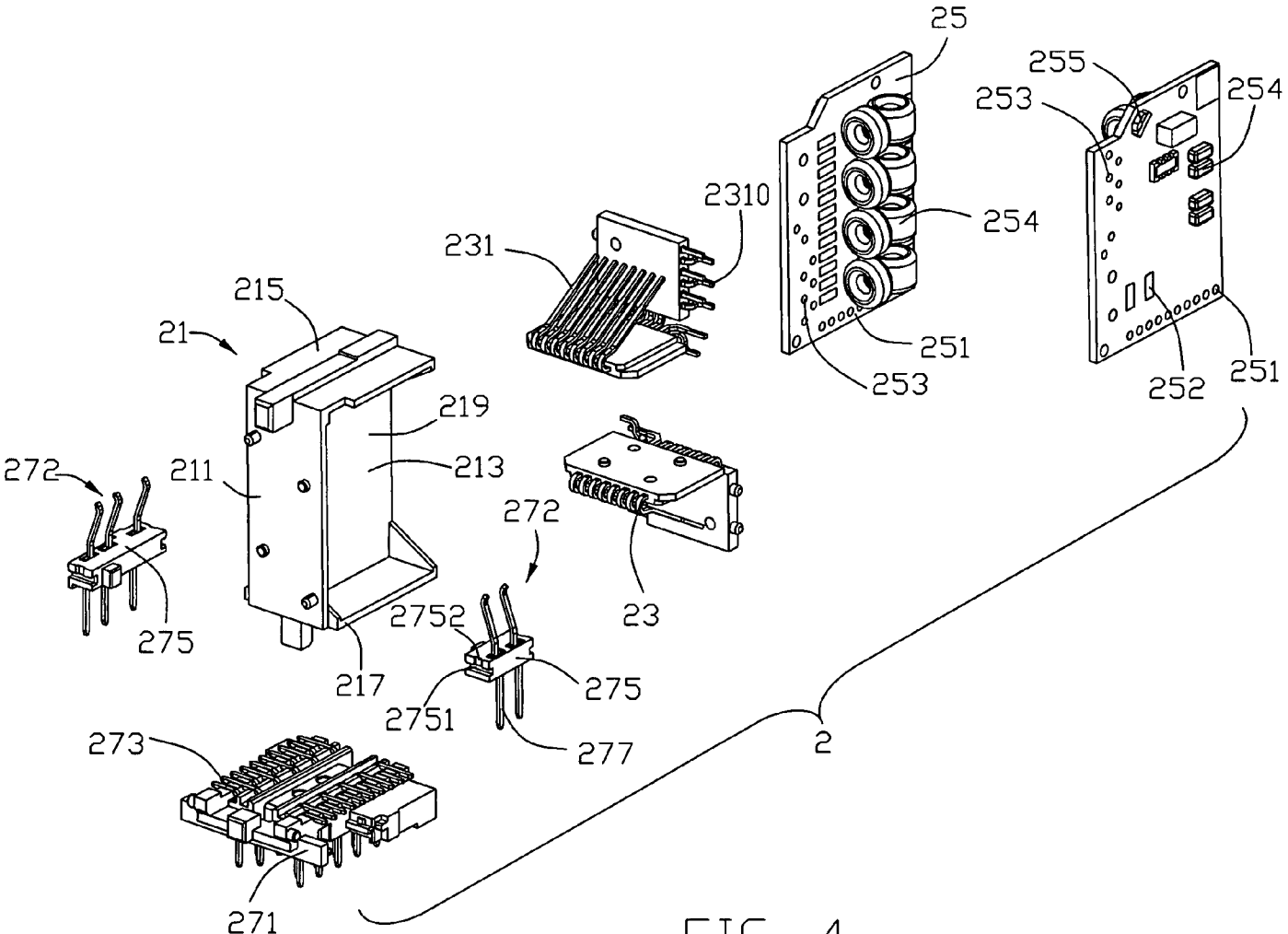
FIG. 4 is an exploded view of an electrical unit as shown in FIG. 2.
Figure 5:
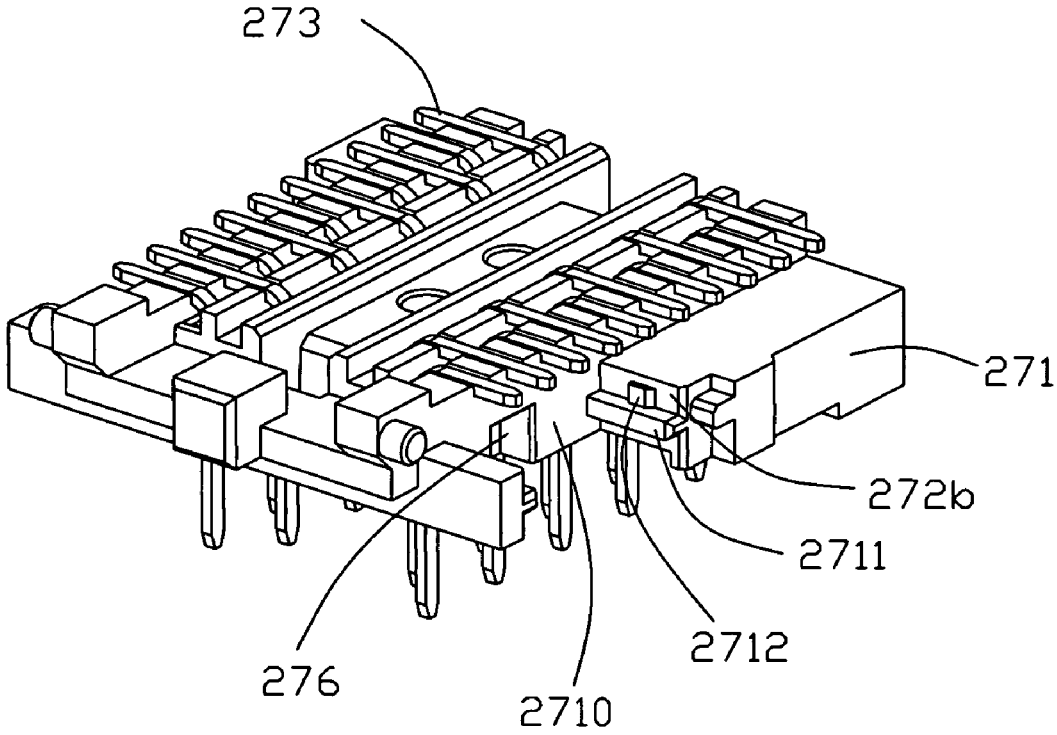
FIG. 5 is a perspective view of a base of a connecting module and a plurality of first pins mounted to the base.
Figure 6:
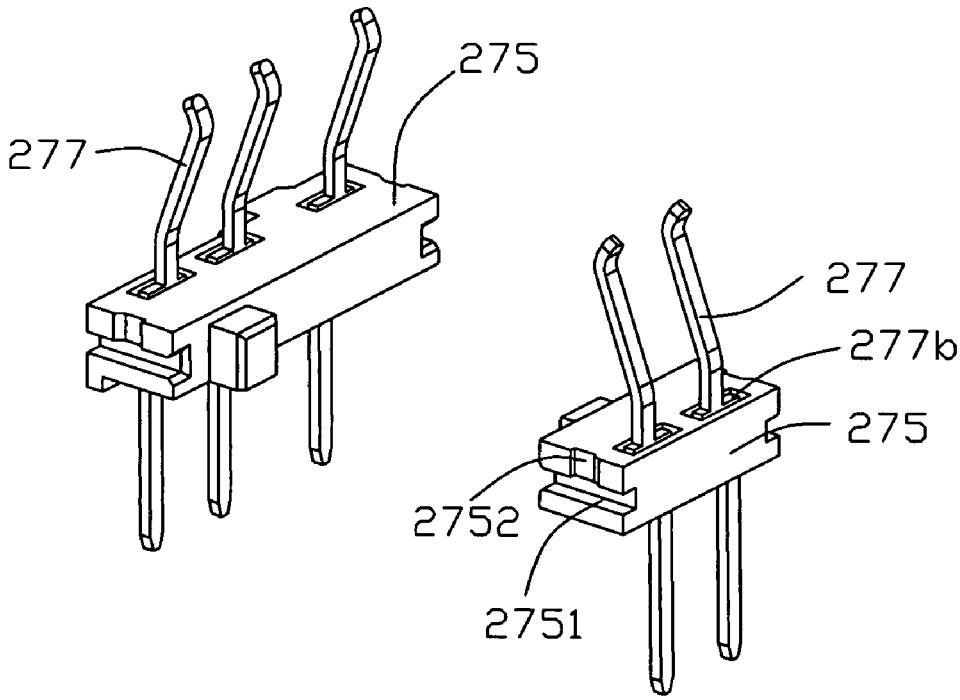
FIG. 6 is a perspective view of a contacting subassembly as shown in FIG. 5 of the connecting module.

As shown in FIGS. 4-6, the connecting module 27 for connecting with the mother board is mounted to the bottom wall 217 of the housing 21 and has a base 271, a plurality of first pins 273 assembled to the base 271 and extending through the second holes 251 of the daughter board 25, and a pair of contacting subassemblies 272. The contacting subassembly 272 includes an inserting member 275 inserting into a side portion of the base 271, and a plurality of second pins 277 exposed from the inserting member 275 and connecting to the pads 252 of the daughter board 25. The base 271 has a cutout 2710 defined on a side portion thereof which is configured to cooperate with the inserting member 275. The inserting member 275 defines a passage 2751 in a transverse direction for engaging with a guiding post 2711 disposed on the lateral surface 272*b* of the base 271. The inserting member 275 has a recess 2752 formed thereon to engage with a rib 2712 formed on the lateral surface 272*b* of the base 271.

Referring to FIGS. 1-4, In assembling, firstly, the terminal module 23 is mounted to a front wall 211 of the housing 21, with the ends 2310 of the terminals inserting through the first holes 253. Secondly, the base 271 of the connecting module 27 mounted to the bottom surface 217 of the housing 21 and the tips of the first pins 273 extending through the second holes 251 of the daughter board 25. Finally, the contacting subassembly 275 is inserted into the cutout 2710 of the base and the second pins 277 are connected with the pads 252 of the daughter board 25. The first pins 273 of the contacting subassembly 272 are connected to the mother board for forming a first electrical trace of the daughter board 25 between the terminals 231 and the first pins 273 of the contacting subassembly 272. The second pins 277 are connected to the mother board for forming a second electrical trace of the daughter board 25 between the LEDs 255 and the second pins 277.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector mounted to a mother board, comprising:

an insulative element; and an electrical unit mounted to the insulative element, the electrical unit comprising:

a housing having a front wall, an intermediate walls, a top wall and a bottom wall;

a terminal module assembled to the front wall of the housing and having a plurality of terminals mounted thereto;

at least one daughter board mounted to a side portion of the intermediate wall; and a connecting module mounted to the bottom wall of the housing and connected to the mother board, the connecting module having a base, a plurality of first pins assembled to the base and extending through the at least one daughter board, and at least one contacting subassembly, the at least one contacting subassembly having an inserting member inserting into the base and a plurality of second pins exposed from the inserting member and connecting to the daughter board.

2. The electrical connector as claimed in claim 1, wherein said base of the connecting module has a cutout defined on a side portion thereof, and wherein the cutout is configured to cooperate with the inserting member of the contacting subassembly.

3. The electrical connector as claimed in claim 1, wherein said inserting member defines a passage in a transverse direction for engaging with a guiding post disposed on a lateral surface of the base.

4. The electrical connector as claimed in claim 3, wherein said lateral surface of the base has a rib engaging with a recess formed on the inserting member.

5. The electrical connector as claimed in claim 1, wherein said printed circuit board has a plurality of first holes for exposing ends of the terminals of the terminal module, tips of the first pins of the contacting subassembly are connected to the mother board so as to form a first electrical trace between the terminals and the first pins of the contacting subassembly.

6. The electrical connector as claimed in claim 1, further comprising a plurality of LEDs (Light Emitting Diodes) disposed on the daughter board.

7. The electrical connector as claimed in claim 6, wherein said daughter board has a plurality of pads disposed thereon for electrically mating with ends of the second pins of the contacting subassembly, opposite ends of the second pins are connected to the mother board so as to form a second electrical trace between the LEDs and the mother board.

8. The electrical connector as claimed in claim 6, further comprising a plurality of lighting pipes retained into the front wall of the housing and cooperating with the LEDs for indicating a condition of an electrical signal of the electrical connector.

9. The electrical connector as claimed in claim 6, further comprising an outer shield surrounding the insulative element.

10. An electrical connector for mounting to a mother board, comprising:

an insulative element; and an electrical unit mounted to the insulative element, the electrical unit comprising:

a housing;

a terminal module assembled to the housing and having a plurality of terminals;

a pair of daughter boards disposed at opposite sides of the housing; and a connecting module mounted to the housing, the connecting module having a base, a plurality of first pins assembled to the base and extending through the daughter boards, and a pair of contacting subassemblies, the contacting subassembly having an inserting member mounted to the base and a plurality of second pins exposed from the inserting member and connecting to the daughter board.

11. The electrical connector as claimed in claim 10, wherein said base of the connecting module has a cutout defined on a side portion thereof, and wherein the cutout is configured to cooperate with the inserting member of the contacting subassembly.

12. The electrical connector as claimed in claim 10, wherein said inserting member defines a passage in a transverse direction for engaging with a guiding post disposed on a lateral surface of the base.

13. The electrical connector as claimed in claim 12, wherein said lateral surface of the base has a rib engaging with a recess formed on the inserting member.

14. The electrical connector as claimed in claim 10, further comprising a plurality of LEDs (Light Emitting Diodes) disposed on the daughter board.

15. The electrical connector as claimed in claim 14, wherein said daughter board has a plurality of pads disposed thereon for electrically mating with ends of the second pins of the contacting subassembly, opposite ends of the second pins are connected to the mother board so as to form a second electrical trace between the LEDs and the mother board.

16. The electrical connector as claimed in claim 14, further comprising a plurality of lighting pipes retained into the front wall of the housing and cooperating with the LEDs for indicating a condition of an electrical signal of the electrical connector.

17. An electrical connector comprising:

an insulative housing defining a mating port;

a plurality of first contacts located in the housing with contacting sections extending into the mating port;

a printed circuit board located behind the mating port and mechanically and electrically connected to tails of the corresponding first contacts, respectively;

a connection device located under the printed circuit board and having an insulative base being equipped with a plurality of second contacts mechanically and electrically connected to a bottom region of the printed circuit board; and a contacting subassembly including an insulative inserting member attached to the base and being equipped with a plurality of third contacts mechanically and electrically connected to the printed circuit board.

18. The electrical connector as claimed in claim 17, wherein the third contacts and the second contacts are located by two opposite surfaces of the printed circuit board.

* * * * *